United States Patent [19]

Townsend

[11] 3,980,404

[45] Sept. 14, 1976

[54] XEROGRAPHIC APPARATUS HAVING IMPROVED FLUID DISPENSING MEMBER

[75] Inventor: Robert H. Townsend, Richardson, Tex.

[73] Assignee: Xerox Corporation, Stamford, Conn.

[22] Filed: July 26, 1974

[21] Appl. No.: 492,175

[52] U.S. Cl. ..... 355/10; 96/1 LY; 118/DIG. 23; 427/15

[51] Int. Cl.[2] ..... G03G 15/10

[58] Field of Search..... 355/10; 118/DIG. 23, 118/258, 259; 96/1 LY; 427/15

[56] References Cited

UNITED STATES PATENTS

| | | | |
|---|---|---|---|
| 3,084,043 | 4/1963 | Gundlach | 96/1 LY |
| 3,383,209 | 5/1968 | Cassiers et al. | 117/37 LE |
| 3,667,428 | 6/1972 | Smith | 117/37 LE |
| 3,709,594 | 1/1973 | Hastwell | 118/259 X |
| 3,712,728 | 1/1973 | Whittaker | 117/37 LE |
| 3,817,748 | 6/1974 | Whittaker | 96/1 LY |

*Primary Examiner*—R. L. Moses
*Attorney, Agent, or Firm*—James J. Ralabate; Donald C. Kolasch; Ernest F. Chapman

[57] ABSTRACT

A xerographic apparatus having an improved liquid developer applicator is disclosed. The liquid developer applicator comprises a hollow, cylindrical, deformable fluid dispensing sleeve member having an outer elastomeric layer characterized by an outer surface having a relief pattern for carrying fluid developer provided from a reservoir to a photoconductor surface. The hollow, cylindrical, deformable fluid dispensing sleeve is also characterized by multiple inner layers which are provided to impart desirable properties and characteristics to the sleeve member. The fluid developer applicator is particularly useful in developing latent electrostatic images on photoconductor surfaces.

3 Claims, 7 Drawing Figures

XEROGRAPHIC APPARATUS HAVING IMPROVED FLUID DISPENSING MEMBER

BACKGROUND OF THE INVENTION

This invention relates to a development in the art of xerography wherein a light and shadow image pattern is developed by passing a liquid ink developer from a dispensing member to an image surface. More particularly, this invention relates to a method for fabricating an improved fluid dispensing sleeve member used for developing or making visible electrostatic images, and further relates to the fluid dispensing sleeve member so fabricated.

In general, the art of xerography is characterized by the formation of an electrostatic image corresponding to the image desired to be reproduced. That image is then developed or made visible by the deposition of electrostatically attractable material onto any suitable surface. In conventional xerographic applications, the electrostatically attractable material is usually a finely divided insulating powder, though in recent years fluid developers such as liquid ink have been the subject of considerable experimentation. The general technique for the fluid development of electrostatic images is well-known, and is described in detail by R. W. Gundlach in U.S. Pat. No. 3,084,043.

Essential to such liquid development techniques is a fluid dispensing sleeve member adapted to receive a quantity of fluid developer, such as electrically charged ink, from conventional applicator means. The dispensing member must be adapted to hold the ink in a stable manner until it is subjected to the attractive forces of an electrostatic image, whereupon the ink is dispensed in conformity with that image. To properly receive and hold ink in this manner, it has been found that the outer surface of the preferably cylindrical dispensing member should have a microscopic pattern of closely spaced grooves, embossments or recesses, sometimes referred to herein as pockets. These pockets are adapted to hold minute quantities of ink by capillary attraction. It has been also found that the outside surface of the dispensing member should be comprised of flexible or elastomeric material to reduce, for example, the possibility of damaging the microscopic pattern when the dispensing member is brought into contact with ink applicator means. Other desirable qualities of the dispensing member include a rigidity or stiffener component which enables the member to maintain its shape, and electrical conductivity properties which enable the member to hold a charge. This latter quality is necessary, notwithstanding the effects of capillary attraction, to maintain ink in the microscopic pockets until pulled away by the electrostatic forces corresponding to the image to be reproduced.

The demanding requirements of the dispensing member have, heretofore, made fabrication both difficult and expensive. For example, the dispensing member does not readily lend itself to fabrication from a full cylindrical mold because the microscopic recesses and embossments thereof interlace with those of the completed member, thereby making it difficult to remove the dispensing member from the mold without damaging the delicately patterned surface. Though a shell or split mold would avoid some of these problems, such a mold suffers from the drawback that it leaves undesirable seams or parting lines on the outer surface of the completed dispensing member. Moreover, dispensing members fabricated from conventional molds are often pockmarked with air bubbles trapped inside the mold. As a result of these and other deficiencies, some efforts have been made to avoid using a mold and instead to try embossing a resilient cylinder. This method of fabrication is impractical, however, because it is laborious and very uneconomical.

Another fabrication problem results, not from the particular method employed, but the type of materials required. More specifically, the seemingly contradictory requirements that the completed member be resilient, rigid and electrically conductive tend to compromise the finished product. Due to these and other problems in designing and fabricating a dispensing member of the type required, liquid development of electrostatic images has remained a promising but impractical xerographic application.

SUMMARY OF THE INVENTION

Now, in accordance with the present invention, an ink dispensing member can be fabricated which meets all of the requirements for liquid development. Additionally, the fabrication method of the invention is economical, simple, and produces an exceptionally high-quality product. In general, the method utilizes the concept of centrifugally casting material onto the interior patterned surface of a full cylindrical mold. The material used is a solidifiable liquid elastomer which is adapted to adhere and harden on the mold's interior.

Because it is preferably an elastomer, the dispensing member can be deformed without damage to its delicate patterned surface which necessarily conforms to the mold. As a result, the completed member can be disengaged simply by collapsing the solidified elastomeric material upon itself and withdrawing it from the mold. Deforming the dispensing member prior to its withdrawal avoids the necessity of removing a completed member having recesses and embossments interlaced with the mold, and thus eliminates the damages associated with that practice.

The essential steps for fabricating such an ink dispensing member include introducing solidifiable material into a mold, coating the interior surface of the mold with the material by rotating the mold, solidifying the material onto the interior surface of the mold, disengaging the material from the mold by deforming the material, and then withdrawing the material from the mold.

Prior to disengaging the material from the mold, additional material, having electrical conductivity or stiffening properties, can be introduced. This subsequently introduced material can then be coated over the solidified elastomeric material, thereby forming a second layer on the dispensing member having characteristics which may differ from the first layer. The multi-layered dispensing member can then be disengaged and withdrawn from the mold in the manner hereinabove described, thus giving it all of the desired properties for liquid development xerographic applications.

The resulting composition is a hollow, cylindrical fluid dispensing sleeve member having an outer elastomeric layer and any number of inner layers. The outer layer is, of course, characterized by an outer surface having a relief pattern corresponding to the microscopic recesses and embossments of the mold. Accordingly, this fluid dispensing sleeve member is uniquely adapted to liquid development applications in the art of xerography.

BRIEF DESCRIPTION OF THE DRAWINGS

A further understanding of the invention will be obtained by reading the following detailed description of the invention in conjunction with the accompanying drawings, in which.

Figure 4:
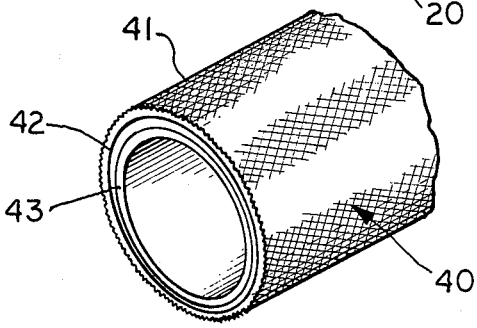
Figure 5:
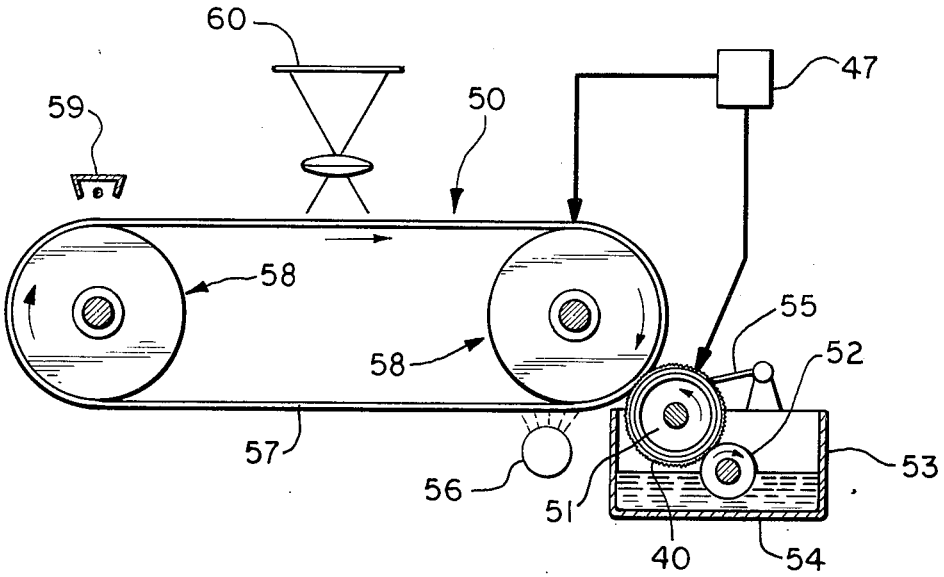
Figure 6:
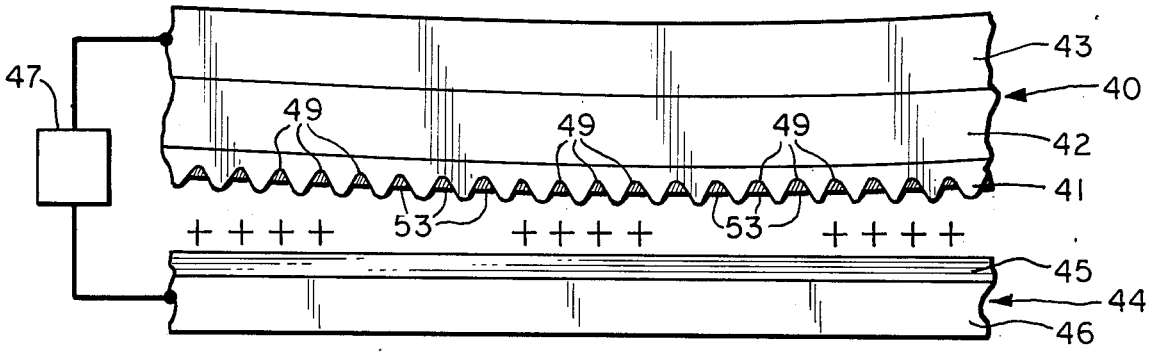
Figure 7:
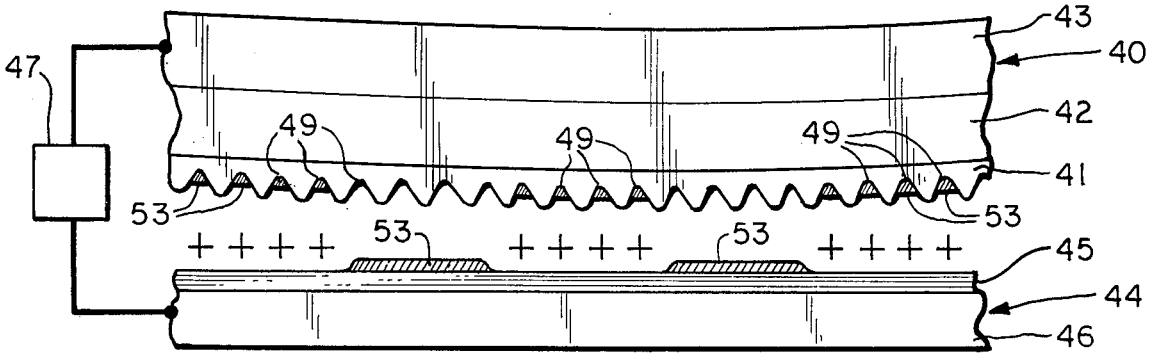

FIGS. *3a*, *3b* and *3c* represent how a completed fluid dispensing sleeve member is disengaged and withdrawn from the mold;

FIG. 4 shows a completed, multi-layered fluid dispensing sleeve member of the invention;

FIG. 5 shows a schematic view of an apparatus incorporating the invention for developing images by the deposition of electrostatically liquid material; and FIGS. 6 and 7 are enlarged schematic illustrations of a portion of the apparatus shown in FIG. 5.

DETAILED DESCRIPTION OF AN EXEMPLARY EMBODIMENT OF THE INVENTION

Figure 1:
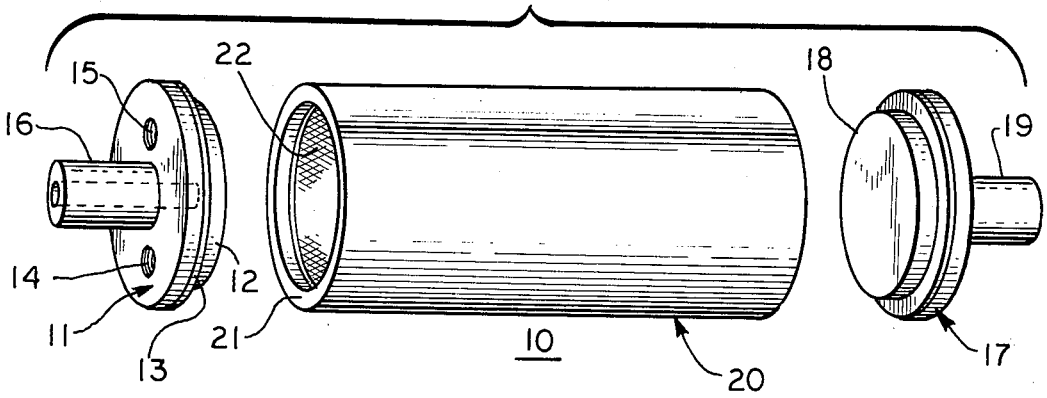
FIG. 1 is an exploded, perspective view of a full cylindrical mold used in fabricating the fluid dispensing sleeve member of the invention.

Referring now to FIG. 1, a full cylindrical mold represented generally by the reference numeral 10 is shown. Mold 10 has a cylindrical mold body 20, open at each end, having an interior surface 22. An embossed, knurled, alpha-numerically scribed, or otherwise formed intricate relief pattern is associated with interior surface 22 of mold body 20. The pattern on interior surface 22 preferably comprises a series of pockets formed by closely spaced grooves, embossments, recesses or the like. These pockets are of microscopic size, spaced no more than one one-hundredth inch apart. In a preferred embodiment, the pockets are spaced five one-thousandths inch apart and three one-thousandths inch deep. It should be observed, of course, that with respect to the preferred pattern on interior surface 22, the stated dimensions for spacing and depth should not be construed as limitative, the scope of the invention being described in the appended claims.

Mold 10 can be fabricated from any material such as brass, aluminum, or steel which can be knurled, embossed, scribed, or otherwise patterned without loosing its structural integrity upon high speed rotation.

Mold 10 further includes a first sealing end 11 and a similar second sealing end 17, at least one of said sealing ends being removable from a respective open end of mold body 20. Sealing end 11 includes a centering circumference 12 and a gasket 13 adapted to provide a liquid-tight seal when sealing end 11 is secured inside one of the open ends of mold body 20. Sealing end 11 further includes an intake port 14 and a gas escape port 15 whose functions are described hereinafter. With the exception of ports 14 and 15, second sealing end 17 is substantially identical to first sealing end 11, and it is therefore unnecessary to describe it in detail.

Mold 10 further includes a concentric shaft 16 secured to the center of first sealing end 11, and a second concentric shaft 19 secured to the center of second sealing end 17. In an alternative embodiment, a unitary shaft extending through the center of first sealing end 11, mold body 20, and second sealing end 19 is employed. In either case, however, the shaft is adapted to permit the rapid rotation of mold 10, the concentricity of the shaft serving to prevent mold 10 from wobbling during rotation.

Mold 10 is adapted to receive, through intake port 14, a quantity of solidifiable material which is to be fabricated into the completed fluid dispensing sleeve member of the invention. As explained in connection with the description of FIG. 2, mold 10 is rotated at high speed creating outward or centrifugal forces which cause the material to uniformly coat interior surface 22 of mold body 20. Since mold 10 encloses a known volume, the quantity of material introduced via port 14 can be selected to form a layer of predetermined thickness on interior surface 22.

Though the materials used in fabricating the completed fluid dispensing sleeve member vary, in one preferred embodiment a liquid mixture comprising a polyurethane pre-polymer, a setting agent for said pre-polymer, and conductive carbon-black is employed. The liquid mixture is introduced through intake port 14, and thereafter solidified to a polyurethane elastomer of Shore A-scale durometer 80 hardness, onto interior surface 22 to conform to the pattern imposed thereon. Further, as described in more detail hereinafter, after the first layer of material is solidified onto interior surface 22 to form the fluid dispensing sleeve member, other layers of material could be added to give the member additional properties.

Figure 2:
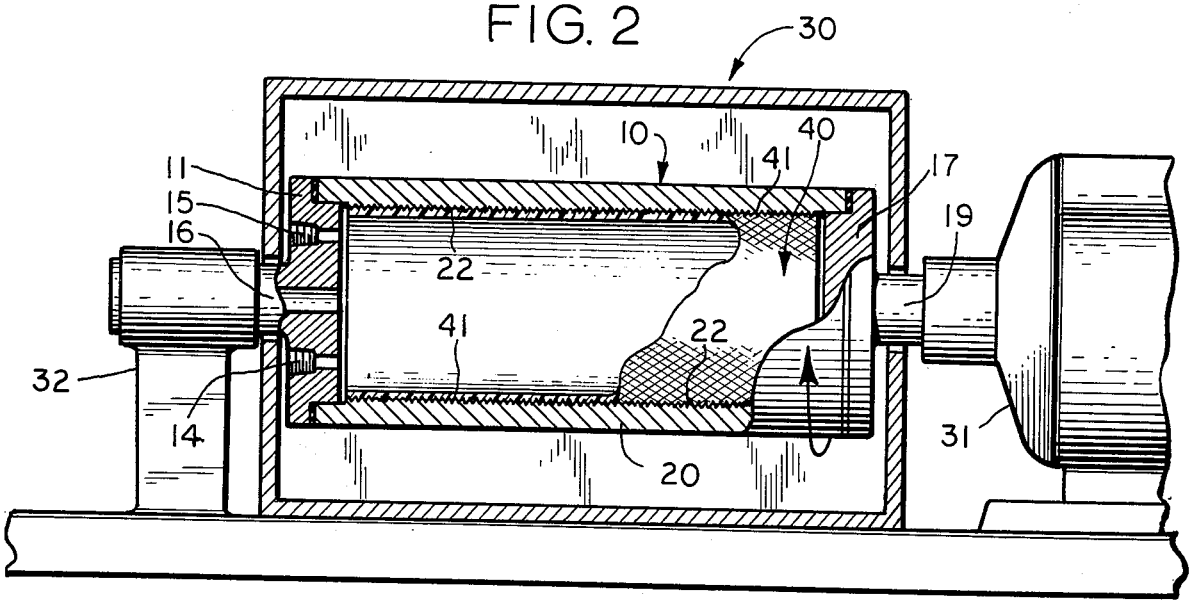
FIG. 2 is a sectional view of the mold appearing in FIG. 1, further showing the means by which material inside the mold is centrifugally cast and solidified onto the inside surface thereof.

Referring now to FIG. 2, there is shown one preferred method for solidifying material introduced via port 14 onto patterned interior surface 22 of mold body 20. More particularly, mold 10 is shown to be disposed in a curing enclosure 30 with its longitudinal axis parallel to the horizontal. Shafts 16 and 19 extend outside enclosure 30 and engage, respectively, a bearing 32 and a motor 31. Motor 31 is adapted to rotate mold 10 at a desired rate, typically 3600 rpm. As mold 10 rotates, the material represented by reference numeral 41, and introduced into mold body 20 via port 14, is moved by centrifugal force away from the longitudinal axis of mold body 20 onto interior surface 22. Simultaneously, air which had heretofore been trapped inside mold 10, is displaced by the heavier material 41 and released through gas escape port 15. As a result, the intricate patterned surface on the completed sleeve member 40 will not be undesirably pockmarked with broken air bubbles.

A source of heat (not shown) preferably disposed inside curing enclosure 30, causes material 41 to solidify and harden onto interior surface 22 of mold body 20. Depending on the composition of material 41, curing occurs during the rotation of mold 10 at temperatures between 280° to 340°F., for periods of time ranging between 10 minutes and 1 hour. For the liquid mixture of a polyurethane pre-polymer, a setting agent and conductive carbon-black described hereinbefore, rotation of mold 10 for 1 hour at a temperature of 320°F. has proven to be successful.

Figure 3A:
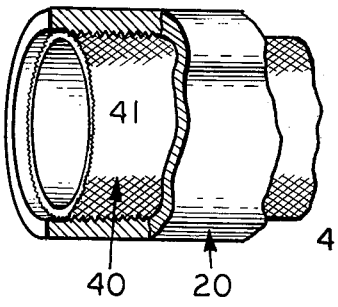
Figure 3B:
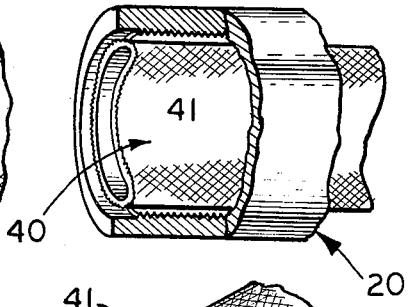
Figure 3C:
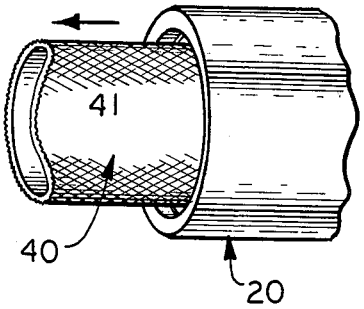

In view of the foregoing, it should be apparent that material 41, when sufficiently solidified and hardened, conforms to the intricate relief pattern formed on interior surface 22. Because the recesses and embossments of material 40 intermesh with those on interior surface 22, the completed sleeve member, designated by reference numeral 40, does not readily slide relative to interior surface 22. However, since sleeve member 40 is now a solidified elastomer, it is flexible and readily deformed. Accordingly, as shown in the sequence of FIGS. 3*a*, 3*b*, and 3*c*, completed sleeve member 40 can be disengaged from interior surface 22 by deforming the material. More particularly, as shown in FIG. 3*b*, sleeve member 40 is collapsed upon itself and then, as illustrated in FIG. 3*c*, withdrawn from mold body 20.

As mentioned hereinbefore, it may be desirable to apply additional layers of material to sleeve member 40 prior to its removal from mold 10. For example, a predetermined quantity of a mixture capable of producing 70 durometer polyurethane can be introduced into mold body 20, and then coated and solidified onto material 41, to add stiffening properties to sleeve member 40. Additional carbon loading can, of course, increase the electrical conductivity of the completed sleeve member. To add resiliency, a third layer can be added by introducing a selected amount of a mixture capable of producing 20 durometer polyurethane, and then repeating the entire process.

The result, as shown in FIG. 4, is a multi-layered fluid dispensing sleeve member having a patterned, outer layer of material 41 such as carbon loaded 80 durometer polyurethane, an intermediate, stiffening layer of material 42 such as 70 durometer polyurethane, and a resilient inner layer of material 43 such as 20 durometer polyurethane. Since the outer layer of material 41 is a flexible or elastomeric layer, it is readily removed from mold 10 in the manner described. To facilitate removal, however, it is preferable to coat interior surface 22 of mold body 20 with a mold release or lubricating material, such as silicone, prior to fabrication of sleeve member 40.

It should be observed, of course, that other materials could also be successfully employed. For example, interior surface 22 can be formed from a solid such as a granular alcohol soluble nylon. Such a solid could be introduced into mold 10, rendered fluidic by dissolution in an appropriate solvent, or melted by heat, and then solidified and cast while rotating onto interior surface 22. Thereafter the solvent could be driven off by any convenient means, and the resulting elastomer could then be solidified in the desired manner. As another example, a liquid or dissolved elastomer material could be introduced.

Referring now to FIG. 6, a portion of the completed sleeve member 40 is illustrated. More particularly, the material 41, comprising the outer layer of sleeve member 40 is shown to have a relief pattern such as a plurality of recesses or pockets 49. In a manner explained hereinafter, pockets 49 are filled with polar fluid developer, such as liquid ink 53, which is maintained in pockets 49 by capillary attraction and/or electrostatic means (not shown). Typically, the inks used in connection with this invention have resistivities from about $10^4$ to $10^{14}$ ohm-cm, and have viscosities of 300 to 5,000 centipoises at 25°C.

Disposed in spaced relationship to sleeve member 40 is an electrostatographic member 44 here comprising a photoconductive layer 45 on a conductive substrate 46. Photoconductive layer 45 is charged and exposed to a light and shadow image pattern in a conventional manner to produce an electrostatic pattern indicated by plus signs in FIG. 6. The sleeve member 40, and liquid ink 53 present thereon, are biased by a source of potential 47 to the same polarity and to substantially the same voltage, as the charge placed on photoconductive layer 45.

Development of the image pattern on photoconductive layer 45 is illustrated in FIG. 7. In particular, when a charge is placed on liquid ink 53, it is attracted to the uncharged portions of photoconductive layer 45. Accordingly, liquid ink 53, in those pockets 49 opposite the uncharged areas on photoconductive layer 45, overcomes the capillary and electrostatic forces holding it in pockets 49, and creeps onto photoconductive layer 45. However, the liquid ink in pockets 49 opposite the charged areas on photoconductive layers remains in pockets 49.

A xerographic apparatus 50 for developing images by the deposition of electrostatically attractable liquid ink is shown in schematic form in FIG. 5. More particularly apparatus 50 includes a photoconductor 57, such as the photoconductive layer 45 of FIG. 6, which is illustrated here as an endless belt disposed around a pair of rollers 58. Photoconductor 57 is charged by means of a corona discharge device 59 and exposed to a selected light and shadow image pattern by exposure means 60. This produces an electrostatic charge on photoconductor 57, corresponding to the light and shadow image pattern selected.

Apparatus 50 further includes a reservoir 54 holding a quantity of liquid ink 53. A rotatable applicator roller 51, having sleeve member 40 fitted thereon, is disposed between a feed roller 52 and photoconductor 57. Upon rotation of feed roller 52, ink 53 is transferred from reservoir 54 to sleeve member 40, and in particular to pockets 49 thereon (FIG. 6). A doctor blade 55 is used to remove excess ink from sleeve member 40.

As explained hereinbefore, sleeve member 40, and ink 53 retained thereon, are biased by a source of potential 47. As a result, development occurs by the transfer of ink from sleeve member 40 to the uncharged portions of photoconductor 57 in the manner described in connection with FIGS. 6 and 7. Following development, the photoconductor 57 is uniformly illuminated by means of a lamp 56. If desired, the developed image on photoconductor 57 may be transferred to a receiving member (not shown) and removed.

It will be apparent to those skilled in the art that numerous modifications, improvements and variations can be made with regard to the invention herein disclosed without departing from its true scope. It is intended, however, that all such modification, improvements and variations are covered by the appended claims.

I claim:

1. A xerographic apparatus comprising:

a. photoconductor means;

b. means for producing on said photoconductor means a selected electrostatic charge;

c. fluid developer;

d. a hollow, cylindrical, deformable fluid dispensing sleeve member having an outer elastomeric layer characterized by an outer surface having a relief pattern for carrying said fluid developer, and multiple inner layers, said inner layers imparting additional properties to said sleeve member, at least one of said inner layers being a stiffening layer;

e. means moving said fluid dispensing sleeve member into relationship with said photoconductor means; and f. potential means, coupled to said fluid dispensing sleeve member, causing said fluid developer carried thereby to pass to said photoconductor means when said fluid dispensing sleeve member is moved into relationship with said photoconductor means.

2. A xerographic apparatus comprising:

a. photoconductor means;

b. means for producing on said photoconductor means a selected electrostatic charge;

c. fluid developer;

d. a hollow, cylindrical, deformable fluid dispensing sleeve member having an outer elastomeric layer characterized by an outer surface having a relief pattern for carrying said fluid developer, and multiple inner layers, said inner layers imparting additional properties to said sleeve member, at least one of said inner layers being a resilient layer;

e. means moving said fluid dispensing sleeve member into relationship with said photoconductor means; and f. potential means, coupled to said fluid dispensing sleeve member, causing said fluid developer carried thereby to pass to said photoconductor means when said fluid dispensing sleeve member is moved into relationship with said photoconductor means.

3. A xerographic apparatus comprising:

a. photoconductor means;

b. means for producing on said photoconductor means a selected electrostatic charge;

c. fluid developer;

d. a hollow, cylindrical, deformable fluid dispensing sleeve member having an outer elastomeric layer characterized by an outer surface having a relief pattern for carrying said fluid developer, and multiple inner layers, said inner layers imparting additional properties to said sleeve member, at least one of said inner layers being an electrically conductive layer;

e. means moving said fluid dispensing sleeve member into relationship with said photoconductor means; and f. potential means, coupled to said fluid dispensing sleeve member, causing said fluid developer carried thereby to pass to said photoconductor means when said fluid dispensing sleeve member is moved into relationship with said photoconductor means.

* * * * *